United States Patent [19]

Blucher

[11] Patent Number: 4,501,185

[45] Date of Patent: Feb. 26, 1985

[54] TRANSDUCER FOR STRINGER MUSICAL INSTRUMENT

[75] Inventor: Steven L. Blucher, New York, N.Y.

[73] Assignee: Dimarzio Musical Instrument Pickups, Staten Island, N.Y.

[21] Appl. No.: 518,684

[22] Filed: Jul. 29, 1983

[51] Int. Cl.[3] ..... G10H 3/18

[52] U.S. Cl. ..... 84/1.15; 84/1.16

[58] Field of Search ..... 84/1.15, 1.16

[56] References Cited

U.S. PATENT DOCUMENTS

| | | | |
|---|---|---|---|
| 2,896,491 | 7/1959 | Lover | 84/1.15 |
| 2,897,709 | 8/1959 | McCarty | 84/1.15 |
| 2,964,985 | 12/1960 | Webster | 84/1.15 |
| 3,711,619 | 1/1973 | Jones et al. | 84/1.15 |
| 3,962,946 | 6/1976 | Rickard | 84/1.15 |
| 4,283,982 | 8/1981 | Armstrong | 84/1.15 |

*Primary Examiner*—Stanley J. Witkowski

*Attorney, Agent, or Firm*—Robert Scobey

[57] ABSTRACT

A transducer for a stringed musical instrument includes a pair of coils mounted adjacent each string of the instrument. The coils have substantially the same number of turns of electrically conducting wire wound thereon, and the wires constituting the coils are of different gauges.

3 Claims, 4 Drawing Figures

TRANSDUCER FOR STRINGER MUSICAL INSTRUMENT

BACKGROUND OF THE INVENTION

This invention relates to transducers, or pickups, for stringed musical instruments whose output is to be electrically amplified. More particularly, the invention pertains to improved transducers providing reduction in undesirable frequency components and improved tonal qualities.

So-called electric guitars or other electrical stringed instruments develop an output for amplification by converting the vibration of the strings to an electrical signal, whose frequency spectrum corresponds to that of the vibration of the strings. Typically, such transducers, or pickups, consist of a permanent magnet element for developing a magnetic field that intercepts the strings and a coil positioned within that magnetic field. When the strings, which are of a ferromagnetic material, are plucked so as to vibrate within the magnetic field, variations in the field pattern caused by the string vibration are detected by the coils to develop an output current which follows the vibration pattern of the strings.

One of the problems encountered in connection with the electrical amplification of the output of stringed instruments is that transducers tend to pick up 60 cycle signals emanating from the power supply employed in the amplifying equipment. The 60 cycle signal is converted to an audible hum in the amplifying equipment which is annoying and degrading to the quality of the musical output. To overcome this 60 cycle hum, transducers have been developed comprising a pair of pickup coils so wound and disposed adjacent one another that the 60 cycle currents induced in the coils cancel one another, effectively eliminating 60 cycle hum from the audio output. A representative prior art patent disclosing such hum cancellation is U.S. Pat. No. 2,896,491 issued to S. E. Lover on July 28, 1959.

Prior hum elimination expedients, while effective in reducing 60 cycle hum, have disadvantages which limit their overall effectiveness. A conventional side-by-side arrangement of coils senses vibrations of each string at two relatively widely spaced points along the string, causing cancellation of certain frequencies other than the 60 cycle hum frequency and consequent degradation of musical quality. With coils mounted one on top of the other, the musical signal is not so degraded but the output signal is relatively weak.

U.S. Pat. No. 3,711,619 which issued to Jones et al on Jan. 16, 1973 discloses a pick-up device involving multiple coils in which the fidelity of sound reproduced is stated as being substantially improved over other conventional pick-up devices. In this patent, the number of turns constituting one winding are substantially different from the number of turns constituting another winding. A turns ratio of 4:1 is disclosed. The patentee discloses forming two different windings of the same size wire, although brief mention is made that different wire sizes may be employed. No special effect from the use of different size wires is disclosed. However, and in any event, the patentee completely fails to understand the hum pick-up problem which would be inherent in this arrangement involving a turns ratio of the coils other than 1:1.

SUMMARY OF THE INVENTION

The present invention avoids the shortcomings of prior two-coil hum-bucking pickups by winding the coils such that both coils of the pair have substantially the same number of turns but are wound with wire of different diameter or gauge. It has been found that by means of this construction, low frequency cancellation is emphasized, providing more effective elimination of 60 cycle hum without affecting the higher harmonics of the 60 cycle signal which may contribute to the desired tonal qualities. Moreover, because of the difference in impedance characteristics resulting from different diameter wire on the respective coils, overall frequency response can be selectively adjusted to provide improved tonal qualities.

BRIEF DESCRIPTION OF THE DRAWING

The foregoing and other objects, features and advantages of the invention will become apparent from the following detailed description thereof when taken in conjunction with the accompanying drawing in which.

DETAILED DESCRIPTION OF THE INVENTION

Figure 1:
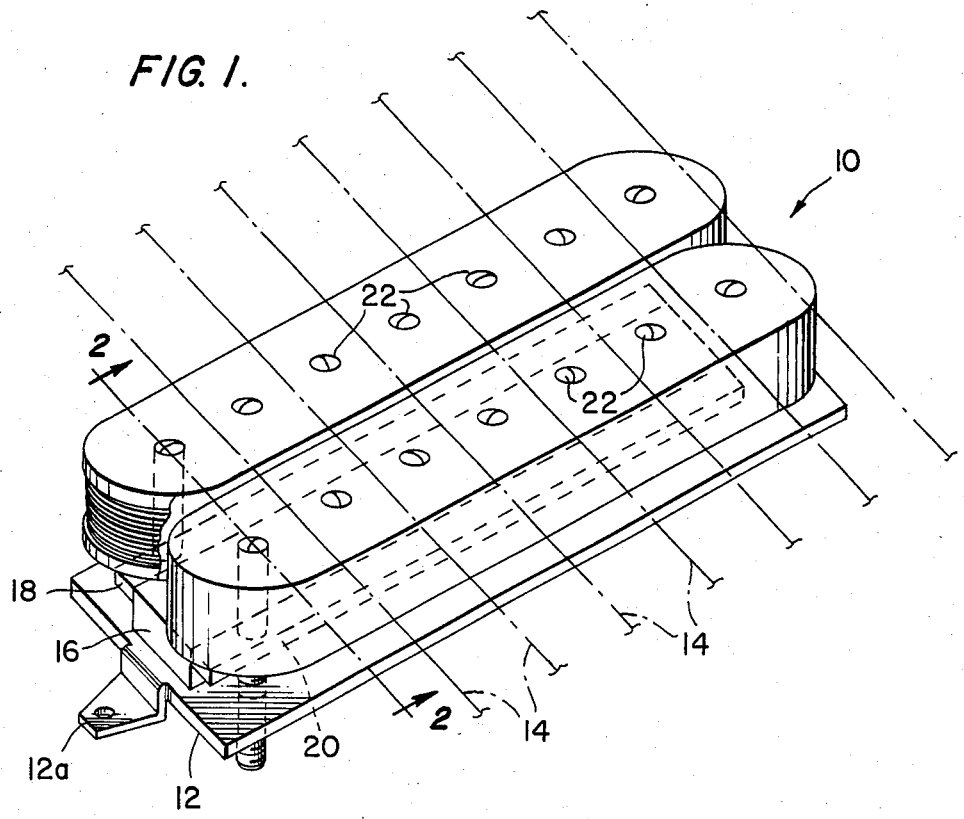
FIG. 1 is a perspective view of a transducer embodying the invention.
Figure 2:
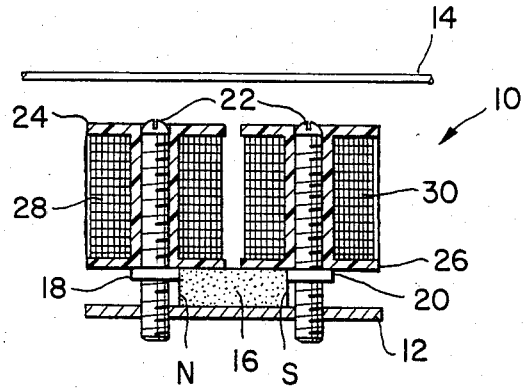
FIG. 2 is a cross-sectional view of the transducer of FIG. 1, taken along the section 2—2 of FIG. 1.

Referring to FIGS. 1 and 2, a transducer 10 is shown of the general type disclosed in the Lover U.S. Pat. No. 2,896,491 noted above. The transducer 10 includes a base plate 12 of brass or similar rigid, non-magnetic material, suitable for mouhting purposes. The base plate 12 includes a mounting foot 12*a* at each of its two ends, used to mount the transducer onto a stringed musical instrument (not shown) such as a guitar. The strings of that musical instrument are shown schematically in FIG. 1 by the dashed lines designated 14. A permanent magnet 16, having one longitudinal edge portion constituting a magnetic north pole and an opposed longitudinal edge portion constituting a maqnetic south pole (as designated in FIG. 2) is positioned upon the base plate 12. The permanent magnet 16, which may be an alnico 5 bar magnet, is generally about as long as the length of the base plate 12. The permanent magnet 16 is positioned between two metallic strips 18 and 20 which bear against the permanent magnet 16. The metallic strips 18 and 20 are of appropriate magnetizable material, and the length of each is approximately the same as that of the permanent magnet 16. Thus the strip 18 constitutes a magnetic north pole and the strip 20 constitutes a magnetic south pole.

The strips 18 and 20 are apertured so that threaded pole pieces 2 may pass therethrough. The pole pieces 22, of metallic and magnetizable material, are conveniently threaded into corresponding holes in the base plate 12. The threaded pole pieces 22 are positioned beneath the strings 14 of the musical instrument, and may be individually adjusted (by being threaded more or less into the base plate 12) to vary the spacing between those pole pieces and the strings 14 of the musical instrument.

The pole pieces 22 pass through bobbins 24 and 26 of suitable non-electrically conductive and non-magnetic and non-magnetizable material. Coil 28 is wound about bobbin 24, and coil 30 is wound about bobbin 26.

The transducer construction, as thus far described, is conventional, and is generally as disclosed in the Lover patent cited above. However, there is an important difference, namely, the diameters of the wires constituting the coils 28 and 30 are different. In particular, the wire size in one coil is appreciably different from that of the other coil. Both coils 28 and 30, however, are wound substantially with the same number of turns.

As an example, one of the coils 28 and 30 may be wound with 5,400 turns of 42 gauge wire, while the other coil may be wound with the same number of turns of 44 gauge wire (American gauge standard).

The gauges of the wires and the number of turns constituting the coils 28 and 30 may be varied, to emphasize different frequencies. By making the number of turns in each coil approximately the same, objectionable hum is avoided. However, the particular number of turns and the gauge sizes selected will depend upon the frequency response desired. Thus low frequency cancellation may be emphasized (the cancellation of signals utilizing the same number of turns in the coils), creating more effective elimination of 60 cycle hum and other undesirable low frequency response, without necessarily affecting the upper harmonics generated in the 60 cycle range. At this time, it is believed that the wire gauge size may vary between 38 gauge and 52 gauge (American gauge standard), corresponding to a variation in wire diameter between about 0.00400 inch and 0.00078 inch. In the example given above, of gauge sizes 42 and 44, the wire diameters correspond to 0.00249 inch and 0.00198 inch.

Figure 3A:
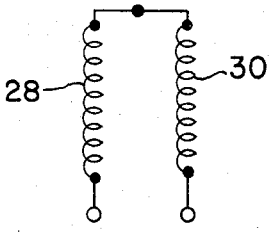
FIGS. 3*a* and 3*b* are electrical schematic diagrams indicating alternative modes of connection of the coils of the transducer of FIG. 1.
Figure 3B:
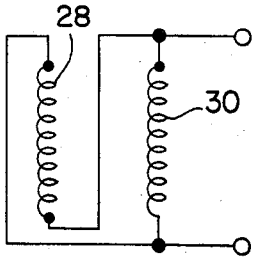

Thus the two coils 28 and 30 are normally wired in a circuit as shown in FIGS. 3*a* and 3*b*. In FIG. 3*a* the coils are connected in series in FIG. 3*b* the coils are connected in parallel. In either arrangement employed, the coil winding direction should be such as to provide for cancellation of low frequency hum signals.

It should be noted that the use of separate coils, positioned side-by-side as in FIGS. 1 and 2, lend themselves to the selective use of those coils *individually,* as desired to achieve unique frequency emphasis in the reproduction of sound. Thus, rather than permanently wire the two coils 28 and 30 either in series or in parallel, as in FIGS. 3*a* and 3*b,* the coils could be individually connected to a switching network (not shown) so that one or the other of the coils alone could be employed for pickup, as desired. Additionally, the switching network could provide for series and parallel connections of coils to emphasize hum, rather than eliminate it, if desired for special effects.

It will be noted that the invention described above of separate coils wound with substantially equal numbers of turns but with differing wire gauges may provide enhanced frequency response and, because of the use of individual coils, a great deal of variation in the frequency response characteristics of the sound amplifying system.

It should be apparent that the presently preferred embodiment of the invention, as described above, is susceptible of modification. Accordingly, the invention should be taken to be defined by the following claims.

I claim:

1. In a transducer for a stringed musical instrument whose output is to be electrically amplified, in which said transducer includes a pair of coils mounted adjacent each string of said instrument, the improvement in which said coils have individual axes and substantially the same number of turns of electrically conducting wire wound thereon, and the wires constituting said coils are of different gauges.

2. A transducer as in claim 1, in which said coil wires range in diameter between about 0.00078 inch and 0.00400 inch.

3. A transducer as in claim 2, in which the wire diameter of one of said coils is about 0.00249 inch, and the wire diameter of the other of said coils is about 0.00198 inch.

* * * * *